United States Patent [19]

Conry

[11] Patent Number: 4,852,362

[45] Date of Patent: Aug. 1, 1989

[54] MODULAR REFRIGERATION SYSTEM

[75] Inventor: Ronald D. Conry, Ringwood, Australia

[73] Assignee: Multistack, Inc., St. louis, Mo.

[21] Appl. No.: 849,499

[22] PCT Filed: Jul. 16, 1985

[86] PCT No.: PCT/AU85/00155

§ 371 Date: Mar. 13, 1986

§ 102(e) Date: Mar. 13, 1986

[87] PCT Pub. No.: WO86/00977

PCT Pub. Date: Feb. 13, 1986

[30] Foreign Application Priority Data

Jul. 24, 1984 [AU] Australia ..... PG6190
Sep. 28, 1984 [AU] Australia ..... PG7409

[51] Int. Cl.[4] ..... F25B 5/00

[52] U.S. Cl. ..... 62/175; 62/201; 62/228.5; 62/434

[58] Field of Search ..... 62/203, 335, 510, 201, 62/228.5, 175, 430, 237, 298, 299, 434, 436; 236/1 EA; 165/143, 144, 145, 172, 175, 176

[56] References Cited

U.S. PATENT DOCUMENTS

| | | | |
|---|---|---|---|
| 88,964 | 4/1869 | Kent | 165/176 |
| 411,476 | 9/1889 | Sturtevant | 165/176 |
| 849,369 | 4/1907 | Clark | 165/176 |
| 2,935,857 | 5/1960 | McFarlan | 62/203 X |
| 3,067,592 | 12/1962 | McFarlan | 62/510 X |
| 3,151,672 | 10/1964 | Edmund | 165/143 |
| 3,526,274 | 9/1970 | Gardner | 165/145 |
| 3,555,251 | 1/1971 | Shavit | 235/151 |
| 3,705,622 | 12/1972 | Schwarz | 165/143 |
| 3,999,160 | 12/1976 | McDonnell | 362/391 |
| 4,112,921 | 9/1978 | MacCracken | 165/176 X |
| 4,210,957 | 7/1980 | Spethmann | 236/1 EA |
| 4,402,190 | 9/1983 | Reid | 62/434 X |
| 4,459,815 | 7/1984 | Yokoyama | 62/126 X |
| 4,483,152 | 11/1984 | Bitondo | 62/175 |
| 4,535,602 | 8/1985 | Alsenz et al. | 62/175 |

FOREIGN PATENT DOCUMENTS

| | | | |
|---|---|---|---|
| 3013518 | 10/1981 | Fed. Rep. of Germany . | |
| 699782 | 11/1953 | United Kingdom | 165/176 |
| 1553217 | 9/1979 | United Kingdom | 62/175 |

*Primary Examiner*—Harry B. Tanner
*Attorney, Agent, or Firm*—Balogh, Osann, Kramer, Dvorak, Genova & Traub

[57] ABSTRACT

A refrigeration system comprises a plurality of assembled modular units each having a refrigeration circuit separate from the circuit of the other units. Each unit includes a housing which defines at least one compartment containing the evaporator of the refrigeration circuit. The condenser is either located in a second compartment in the housing or in a separate chamber associated therewith. A first heat exchange fluid is conveyed to and from the compartment by header pipes, the header pipes of adjacent units being interconnected to form common manifolds for the system. A second heat exchange fluid is circulated passed the condensers of each unit. Electrical controls are provided on each unit to control and monitor operation of the respective refrigeration circuit the controls being interconnected to enable overall control of each unit of the system in accordance with load demand.

8 Claims, 6 Drawing Sheets

MODULAR REFRIGERATION SYSTEM

FIELD OF THE INVENTION

This invention relates to modular refrigeration systems and relates particularly to such refrigeration systems for use in air conditioning installations.

Air conditioning installations for modern buildings, such as large office structures, shopping complexes, warehouses and the like, conventionally comprise air treatment units to which water or other heat exchange fluid is pumped whereby air is cooled (in summer) or heated (in winter) and circulated to the areas to be conditioned. The heat exchange fluid for cooling is generally circulated through an evaporator/chiller of a refrigeration system which removes heat from the fluid. The heat is given up to a second heat exchange fluid which circulates passed the condenser of the refrigeration system. The second heat exchange fluid may also comprise water or other liquid or may comprise air in an air cooled or evaporative cooler system. Such systems may also be designed to operate on reverse cycle and act as heat pumps to heat the air to be conditioned. The refrigeration system will, of course, have cooling/heating capacity appropriate to the capacity of the air conditioning installation.

BACKGROUND OF THE INVENTION

For high capacity installations, as may be incorporated in office and apartment blocks, a refrigeration system of high output is necessary to be able to handle the maximum load expected. In practice, such high output refrigeration systems tend to be more prone to breakdown and failure than do lower output refrigeration units. Such breakdowns and failures often leave the building in which the system is installed without any air conditioning until the breakdown or failure is remedied. In high capacity systems, breakdowns and failures can often take days and, sometimes, weeks to repair.

Further, in the design and construction of many modern building structures, provision is made for the expansion of the building structure, that is, the building is constructed in a number of stages spread over a period of time. Because of the difficulty in expanding a predesigned air conditioning system, it is generally necessary to design and install the system to have the air conditioning capacity for the completed building structure. This means, therefore, that the system is running, inefficiently, at less than full load capacity until such time as all building stages are completed.

In other instances, building structures are extended after the initial design and construction, and such extensions often require the air conditioning system for the initial building structure to be completely replaced with a new system to be able to handle the load of the extended building structure.

BACKGROUND ART

Australian Patent Specification No. 218,986 in the name of Alden Irving McFarlan discloses an air conditioning system for buildings having areas which require heating and cooling, the system incorporating separate air treating units for each of the different areas. The system described incorporates a number of individual refrigeration units comprising separate compressors, evaporators and condensers. These can be automatically and individually controlled for starting, stopping and unloading of the compressors to maintain high efficiency of operation at less than peak loads. However, the condensers for each refrigeration unit are connected in series as are the water circuits of the evaporator/chillers thus requiring each refrigeration unit to have individual design criteria in accordance with the variation in temperature of the water circulating through the individual, series connected condensers and evaporator/ chillers.

It is desirable to provide an improved refrigeration system which obviates the disadvantages of the known systems.

It is also desirable to provide an improved refrigeration system which allows the design and construction of an air conditioning system for a building or like structure, which air conditioning system is less prone to breakdown and failure than known air conditioning systems.

It is also desirable to provide an improved refrigeration system particularly for air conditioning and in which a breakdown or failure of part of the refrigeration system does not prevent operation of the air conditioning plant.

It is further desirable to provide an improved air conditioning system using discrete refrigeration units which can be removed, repaired and/or replaced without major disruption of the operation of the air conditioning system.

SUMMARY OF THE INVENTION

According to one aspect of the present invention there is provided a refrigeration system formed by a plurality of modular units, each unit comprising at least one refrigeration circuit separate from the or each circuit of the or each other unit, a housing carrying the or each circuit of the unit, said housing defining at least one passage for flow of heat exchange fluid in heat exchange relation with at least one heat exchange element of the circuit, said flow passage being adapted for communication with a corresponding flow passage of the or each other unit, and control means for controlling operation of the assembly of units.

Each modular unit preferably has an evaporator circuit in the housing and separated from a condenser circuit in the housing. With this arrangement, the housing defines one passage for the flow of heat exchange fluid in heat exchange relation with the evaporator circuit and a second passage for flow of a second heat exchange fluid in heat exchange relation with the condenser circuit.

In a particular form of the invention, headers are provided on or incorporated in the housing to convey heat exchange fluid to and from the flow passages in the housing. The headers of each housing are adapted to be connected to headers of the or each adjacent unit.

Preferably, the control means is operative to cause progressive actuation of the units in sequence in response to increasing load demand, the sequence of actuation being automatically changed at periodic intervals whereby to substantially equalize usage of all units over a prolonged period. In a particularly preferred embodiment, one of the modular units is designated a master unit and is provided with electric control means to which other, slave units are connected whereby operation of all units is controlled by the master unit. The control means so arranged that, in the event of a failure of one of the modular units, that unit is electrically disconnected from service and an appropriate alarm indication is given. For this purpose, each modular unit is provided with appropriate sensors to monitor operation of the respective units.

According to another aspect of the invention there is provided a refrigeration system comprising a plurality of refrigeration units, each unit having compressor means, a refrigerant condensing circuit incorporating a condenser, a refrigeration evaporator circuit incorporating an evaporator, means for circulating a first heat exchange fluid passed the evaporator and means for circulating a second heat exchange fluid passed the condenser, characterized in that each unit includes a modular housing for the respective evaporator and the respective condensor, the housing defining at least one flow passage for the first heat exchange fluid in heat exchange relation with the evaporator, means on the housing for mounting the compressor means, header means for supplying the first heat exchange fluid to said at least one flow passage and for conveying said fluid therefrom, and means for passing the second heat exchange fluid passed the condenser.

In the most preferred form, each modular housing has sides which abut opposed sides of adjacent units, the header means of abutted units being interconnected to form common manifolds for supply and return of the respective heat exchange fluids. Each unit preferably comprises two refrigerant compressors with separate condenser and evaporator circuits. The modular housing houses both evaporators in one compartment which defines a single flow passage for the first heat exchange fluid. The modular housing of each unit also houses both condensers in a second compartment which defines a single flow passage for the second heat exchange fluid.

Each said header means may comprise a fluid supply pipe and a fluid return pipe communicating with the respective flow passages, the supply and return pipes of each unit having connection means for coupling two respective pipes of adjacent units.

DESCRIPTION OF THE PREFERRED EMBODIMENTS

Figure 1:
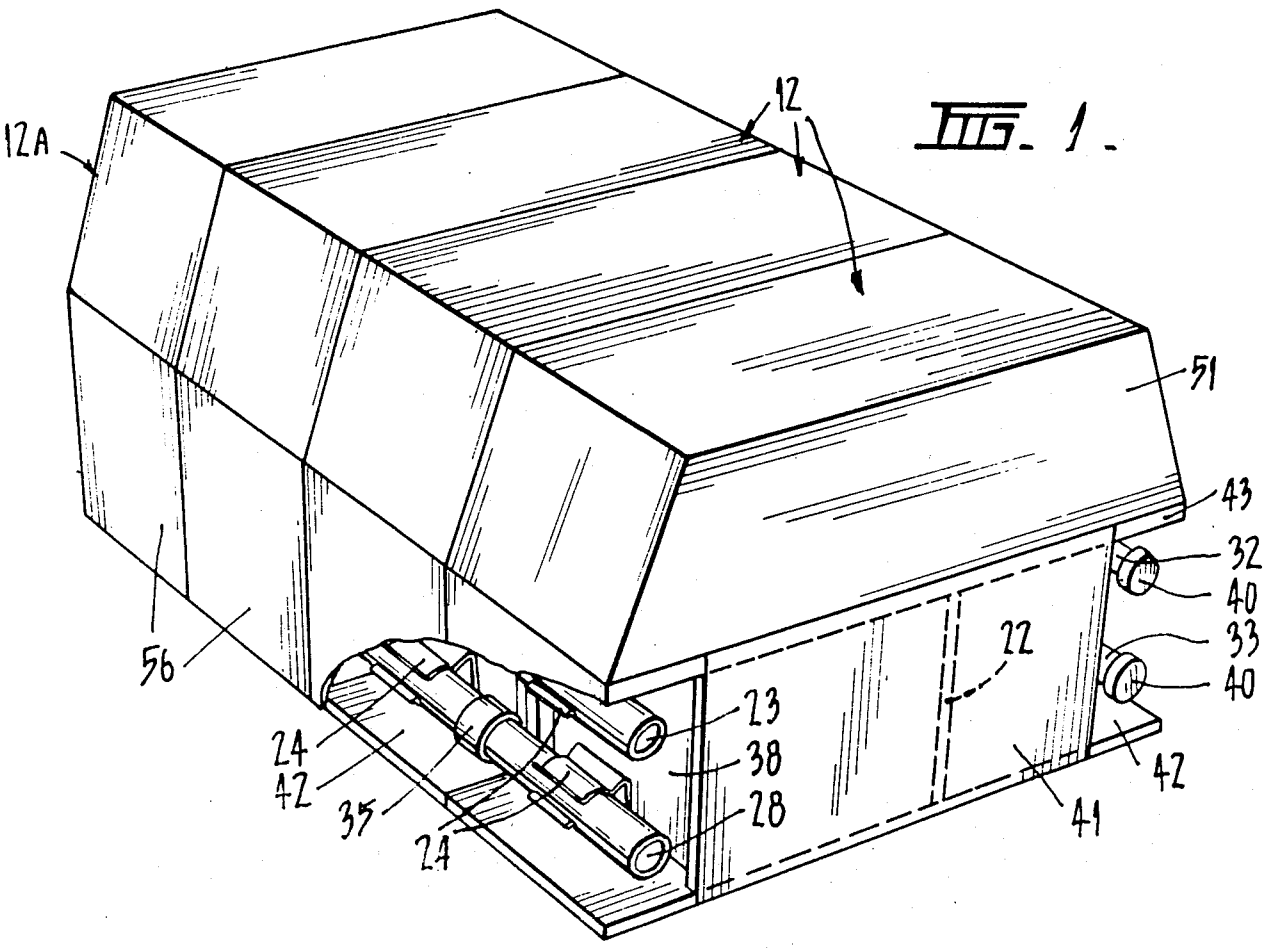
FIG. 1 is a perspective view of a plurality of interconnected modular refrigeration units in accordance with the present invention.
Figure 2:
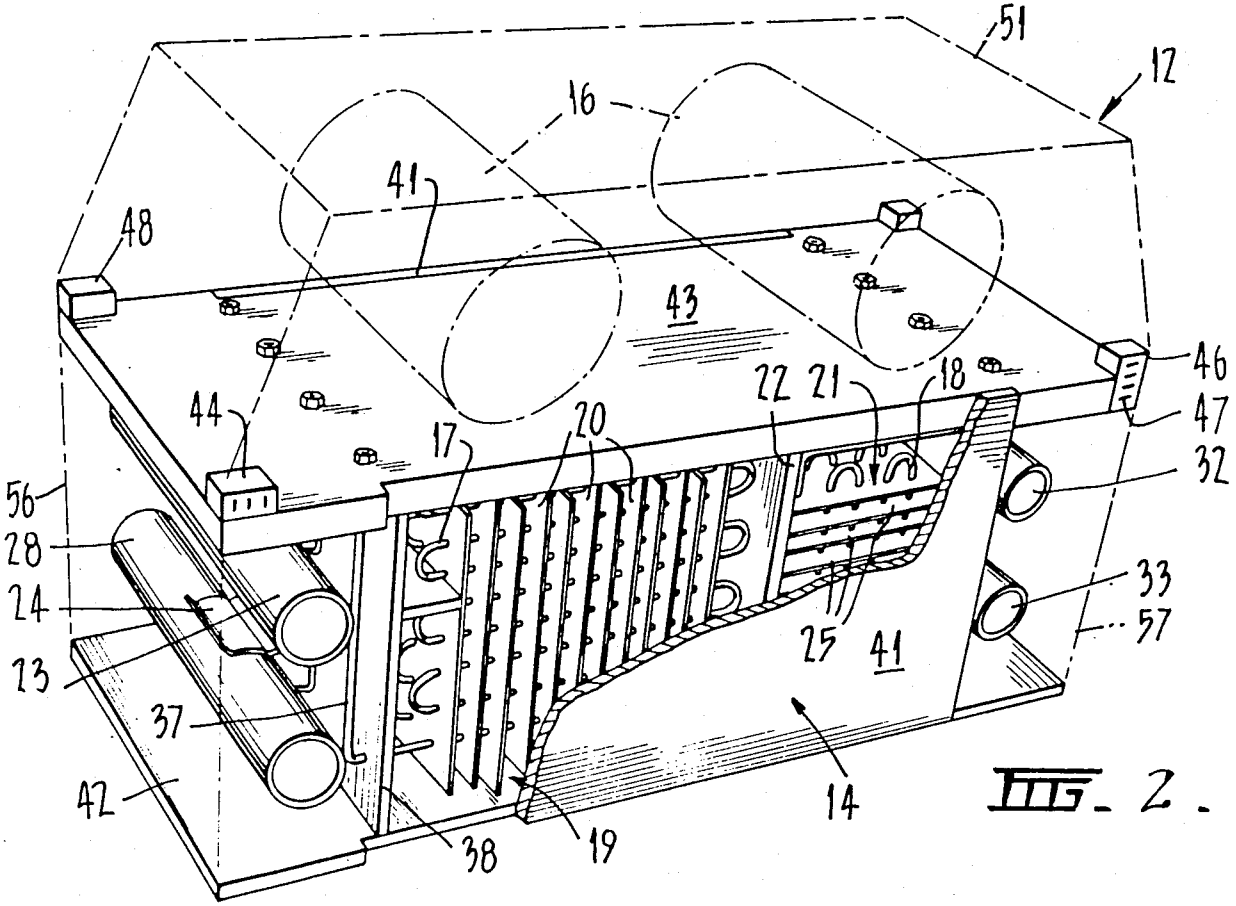
FIG. 2 is a part cut-away perspective view of one modular refrigeration unit in accordance with the invention.
Figure 3:
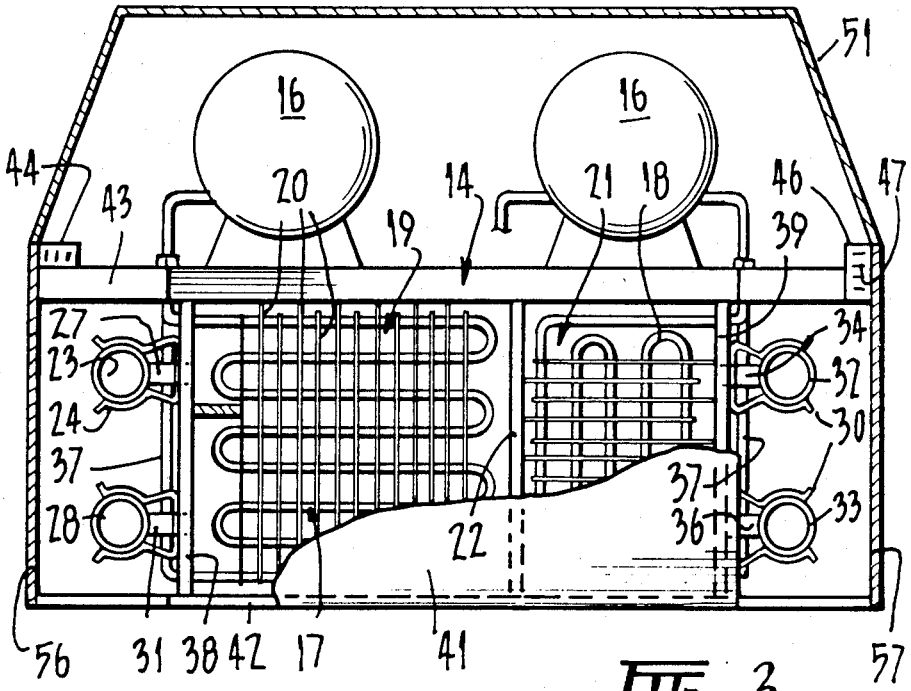
FIG. 3 is a part sectional, side elevational view of the modular unit of FIG. 2.
Figure 4:
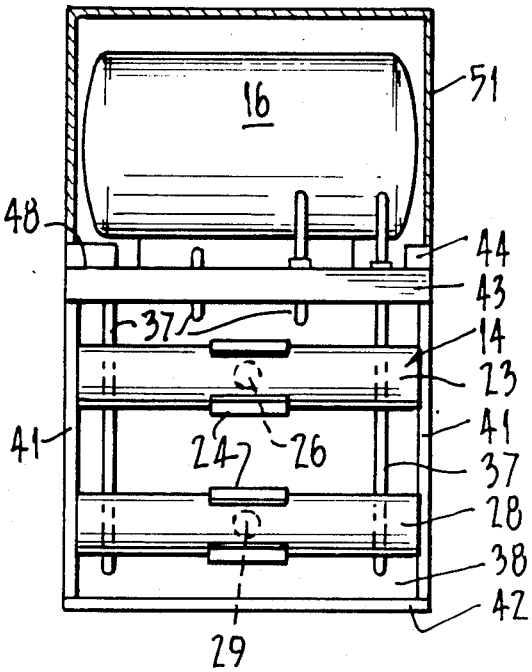
FIG. 4 is a front elevational view, with the front panel removed, of the modular unit of FIG. 2.
Figure 5:
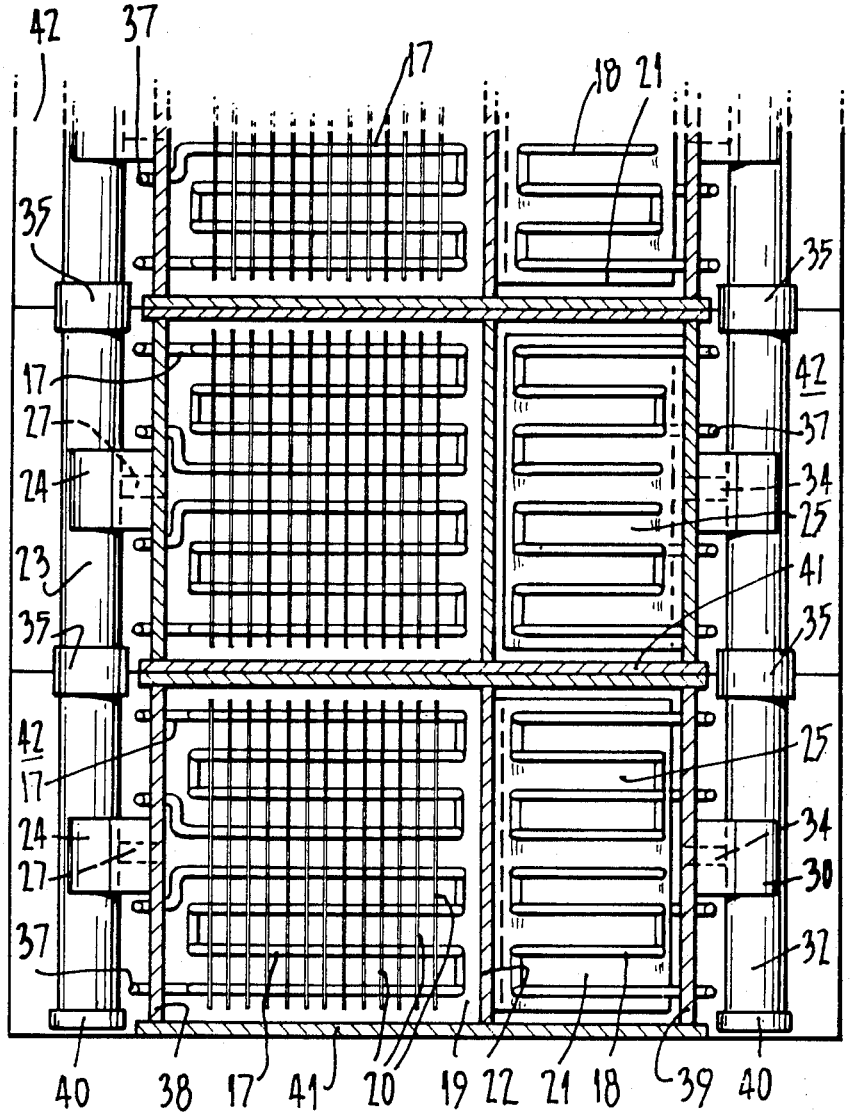
FIG. 5 is a cross-sectional plan view of several interconnected modular units in accordance with the invention.

With reference to FIG. 1, a refrigeration system for use in an air conditioning installation, particularly a high capacity installation, comprises a series of modules 12 arranged in face-to-face relation. As shown in FIGS. 2 to 5, each module comprises a housing 14 on which is mounted two sealed unit refrigeration compressors 16. The housing 14 is formed of a bottom wall 42, side walls 41, a front wall 38, a rear wall 39 and a top wall 43. The housing 14 is divided into two compartments 19 and 21 separated by the partition 22. Compartment 19 contains a pair of evaporator coils 17, one for each compressor 16, and compartment 21 contains two condenser coils 18. An appropriate refrigerant expansion device (not shown) is connected between the respective evaporator and condenser of each refrigeration circuit, in a known manner. The compartments 19 and 21 define separate fluid flow passages which serve to carry separate flows of heat exchange fluid, for example water, in heat exchange relation with the evaporator coils 17 and the condenser coils 18.

Baffles, shown generally at 20, act to direct the flow of heat exchange fluid into intimate contact with the evaporator coils 18 while similar baffles 25 in compartment 21 act in a similar manner with regard to the condenser fluid flow.

The heat exchange fluid, i.e. water, which is to be cooled by the evaporator coils 17, is supplied to the compartment 19 by a header pipe 23 mounted on the front wall 38 of the housing 14 by bracket 24. The header pipe 23 has an opening 26 which communicates with an inlet tube 27 extending from the compartment 19.

Cooled water is taken from compartment 19 through the lower header pipe 28 on the front wall 38 of the housing 14. The lower header pipe 28 has an opening 29, similar to opening 26, which communicates with an outlet tube 31.

Header pipes 32 and 33 are mounted on the rear wall 39 of the housing 14 on brackets 30 and communicate with the compartment 21 by similar openings and tubes 34 and 36, respectively. The header pipe 33 conveys cooling water to the condenser coils 18 in compartment 21, the cooling water being removed through the header pipe 32.

Each of the header pipes 23, 28, 32 and 33 are of a length enabling end-to-end connection with corresponding header pipes of adjacent modules 12 to form a common series of fluid manifolds. A releasable coupling generally indicated at 35, such as that known by the trade mark VICTAULIC, is used to form fluid tight connections between the pipe ends. End caps 40 are used to seal the ends of the header pipes of the last module 12 of the assembly while appropriate fluid supply and return lines (not shown) are connected to the header pipes of the first module 12.

Pipes 37 for conveying refrigerant between the compressors 16, condenser and evaporator coils 18, 17, respectively extend down and through the front and rear walls 38 and 39 of the housing 14 to the respective coils.

The side walls 41 on each side of the housing 14 are removable to give access to the compartments 19 and 21. The side walls are sealed against the housing bottom wall 42, the top wall 43 on which the compressors 16 are mounted, the partition 22 and the front and rear walls 38 and 39 to ensure that the compartments 19 and 21 are fluid tight. It will be appreciated, however, that the evaporator coils 17 and the chiller water flow passages can be incorporated in a series of heat exchange plates which define the separate passageways for the respective fluids, thus obviating the need to provide a fluid tight compartment. Such plates are known in the art and are not described herein in detail.

The top wall 43 of the housing 14 has mounted along the rear edge thereof an electrical bus bar 46 to which the compressors 16 are electrically connected. The bus bar 46 has appropriate connections 47 at each end to enable the bus bars of adjacent units to be interconnected to provide continuity of electrical power supply to each unit.

Although the compressors 16 mounted on the top wall 43 of the housing 14 may be exposed, it is preferred that a top cover 51 is provided over the compressors 16. The top cover 51 is removable without removing the respective module 12 from the assembly to facilitate service and maintenance. Removable front and rear cover plates 56 and 57, respectively, are also provided on the housing 14.

As described above, each module 12 comprises a separate refrigeration unit comprising two refrigeration circuits. The refrigeration circuits of each unit are, essentially, independent of those of each of the other modules, with each circuit including its own control means in order to deactuate the refrigeration unit in the event of an overload or other malfunction occurring in that unit. The control means includes an electrical control panel 48 mounted on the top wall 43 of the housing 14. The control panel 48 receives signals from sensors (not shown) associated with operation of the refrigeration units and transmits those signals through electrical connections 44 on the front of the housing 14 to a master control panel located on one of the modules 12 in the system, preferably an end module 12A. The master control panel houses the electrical control circuits for the control of the assembly of the modules 12 in accordance with the desired operation or control of the air conditioning installation whereby the cooling effect of the system (or the heating effect if the refrigeration units are acting in a reverse cycle mode) meets the instantaneous requirements of the air conditioning installation. Under part load conditions, the control circuits are operative to actuate only one or some of the modules 12 (depending on the load) with other units being brought into operation as the load increases. Advantageously, the control circuits are operative to automatically switch, at predetermined intervals, the order in which the modules 12 are brought into operation in order to substantially equalize the usage of the individual modules over a prolonged period of time. The control circuits may include memory circuits which maintain a constant record of the hours of operation of each module 12, the information being used to ensure substantial equalization of usage of the individual modules over a period of time.

A simple microprocessor can be used to control the progressive switching functions and to match operation of the refrigeration system to the load requirements of the air conditioning installation to which the system is connected.

The modular construction described permits additional slave modules 12 to be added to the assembly in order to increase the capacity of the refrigeration system resulting from changes in load criteria of the air conditioning installation. In the event of a malfunction in one of the modules 12, that module may be shut down by the control circuits, while permitting continued operation of the other modules. Depending on the fault, the defective module may be repaired in situ while the system is in operation, or the defective module may be removed from the assembly for repair, a spare module being incorporated in the assembly to replace the removed, defective module or the assembly being permitted to operate without a replacement. Naturally, if a module is removed from the assembly for repair or maintenance, the header pipes 23, 28, 32 and 33 of the modules 12 on each side of that to be removed are connected together by temporary pipe connections to maintain the heat exchange fluid circuits. Similar temporary electrical connections are also made.

Figure 6:
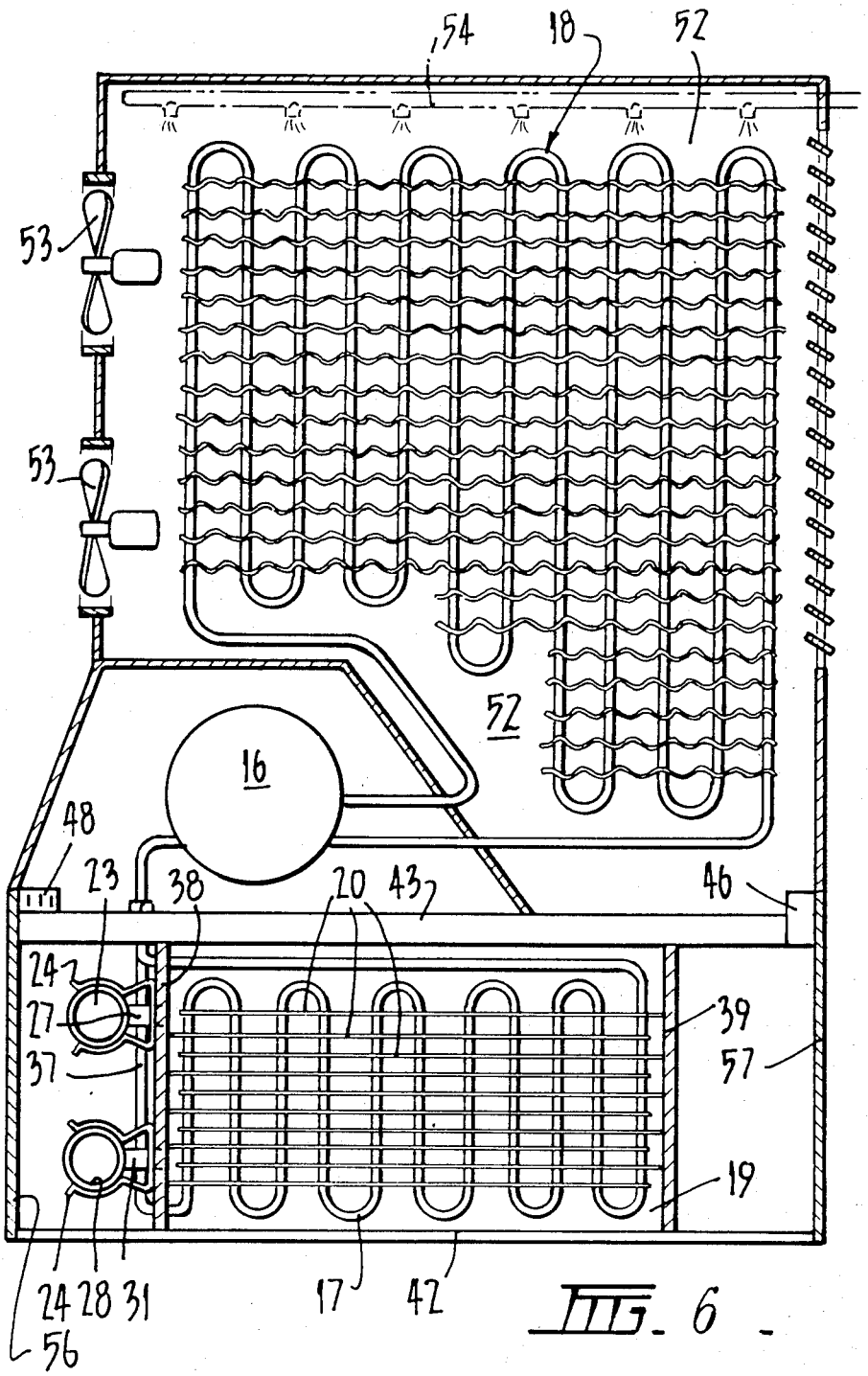
FIG. 6 is a side elevational, part cross-sectional view of a further embodiment of the invention.

Referring to FIG. 6, in this embodiment which uses a single compressor 16, the housing 14 has a single compartment 19 for the evaporator coil 17 while the condenser coil 18 is located in an air cooling chamber 52 located above the compressor 16. Fans 53 draw air through the chamber 52 to cool the finned condenser coil 18.

In some installations, an evaporative condenser is used and for this purpose water sprays 54 (shown in dotted lines) spray water over the condenser coil 18.

A refrigeration system formed in accordance with the present invention utilizing a number of modules 12 assembled together to form a single unit will have a reliability related to the reliability of the individual modules 12, which is substantially better than the reliability of a single refrigeration unit of equivalent output. The reliability is further enhanced, in accordance with the invention, by the continued operation of other modules of an assembly if one module is shut down for repair or maintenance. A system of increased capacity can be obtained in accordance with the invention simply by adding additional modules, as required, to take account of any increase in load resulting from a building extension or the like.

The use of header pipes to form common manifolds for supply and return of heat exchange fluid facilitates interconnection of the separate refrigeration units and allows modular construction of identical units which can be mass produced for relatively less cost than fabricated units. The modular units are readily assembled into complete units of any desired capacity.

As indicated above, the refrigeration circuits may be adapted for reverse cycle operation, if desired.

It will be understood that the refrigeration system of the invention can be used for purposes other than air conditioning installations. Thus, the modular system is particularly useful for cool storage, cool rooms and freezer rooms in food processing and handling industries and in any other area requiring the use of relatively large capacity refrigeration.

I claim:

1. An expandable refrigeration system for transferring heat from one fluid to another where a total load requirement is supplied by a plurality of modular units, comprising:

an assembly of a plurality of readily interconnectable and transportable, substantially identical complete modular refrigeration units each of which includes:

a housing means to carry at least one refrigeration circuit including an electrically powered compressor means, evaporator means and condenser means, each said housing further containing a first fluid flow passage means for flow of a first fluid in heat exchange relation with said evaporator means, and a separate second fluid flow passage means for flow of a second fluid in heat exchange relation with said condenser means, a first fluid supply means in fluid communication with the first fluid flow passage means to supply said first heat exchange fluid thereto, a first fluid return means in fluid communication with said first fluid flow passage means to remove said heat exchange fluid therefrom, second fluid supply means in fluid communication with said second fluid flow passage means to supply said second heat exchange fluid thereto, said first fluid supply means and said first fluid return means comprising header pipes extending laterally of said housing means, and releasable connecting means interconnecting adjacent ends of said header pipes of adjacent modular units to form a unitary fluid supply manifold and a unitary fluid return manifold for the assembly to interconnect the first flow passage of respective units in parallel, and to readily enable replacement or addition or removal of a unit from the system.

2. An expandable refrigeration system for transferring heat from one fluid to another where a total load requirement is supplied by a plurality of modular units, comprising:

an assembly of a plurality of readily interconnectable and transportable, substantially identical complete modular refrigeration units each of which includes:

a housing means to carry at least one refrigeration circuit including an electrically powered compressor means, evaporator means and condenser means, each said housing further containing a first fluid flow passage means for flow of a first fluid in heat exchange relation with said evaporator means, and a separate second fluid flow passage means for flow of a second fluid in heat exchange relation with said condenser means, a first fluid supply means in fluid communication with the first fluid flow passage means to supply said first heat exchange fluid thereto, a first fluid return means in fluid communication with said first fluid flow passage means to remove said heat exchange fluid therefrom, second fluid supply means in fluid communication with said second fluid flow passage means to supply said second heat exchange fluid thereto, said first fluid supply means and said first fluid return means comprising header pipes extending laterally of said housing means, and releasable connecting means interconnecting adjacent ends of said header pipes of adjacent modular units to form a unitary fluid supply manifold and a unitary fluid return manifold for the assembly to interconnect the first flow passage of respective units in parallel, and to readily enable replacement or addition or removal of a unit from the system, and sensor actuated control means connected to each unit of the system to cause progressive actuation of respective units in a predetermined sequence in response to changing load demand.

3. A refrigeration system according to claims 1 or 2, wherein each modular unit has two refrigeration circuits and said first flow passage means directs said first fluid flow into heat exchange contact with the two evaporators of the two refrigeration circuits.

4. A refrigeration system according to claims 1 or 2, wherein each modular unit has two refrigeration circuits and said second flow passage means directs said second fluid into heat exchange contact with the two condensers of the two refrigeration circuits.

5. A refrigeration system according to claim 3, wherein said separate condensers of the two refrigeration circuits of each unit are connected in parallel in said second flow passage.

6. A refrigeration system according to claims 1 or 2, wherein said first fluid is water.

7. A refrigeration system according to claims 1 or 2, wherein said second fluid is water.

8. A refrigeration system according to claims 1 or 2, wherein said second fluid is air.

* * * * *

US004852362C1

(12) EX PARTE REEXAMINATION CERTIFICATE (6762nd)

United States Patent
Conry

(10) Number: US 4,852,362 C1
(45) Certificate Issued: Apr. 14, 2009

(54) MODULAR REFRIGERATION SYSTEM

(75) Inventor: Ronald D. Conry, Ringwood (AU)

(73) Assignee: Multistack LLC, West Salem, WI (US)

Reexamination Request:
No. 90/008,486, Feb. 9, 2007

Reexamination Certificate for:

| | |
|---|---|
| Patent No.: | **4,852,362** |
| Issued: | **Aug. 1, 1989** |
| Appl. No.: | **06/849,499** |
| Filed: | **Mar. 13, 1986** |

(22) PCT Filed: Jul. 16, 1985

(86) PCT No.: PCT/AU85/00155

§ 371 (c)(1),
(2), (4) Date: Mar. 13, 1986

(87) PCT Pub. No.: WO86/00977

PCT Pub. Date: Feb. 13, 1986

(51) Int. Cl.
*F25B 5/00* (2006.01)

(52) U.S. Cl. ..... 62/175; 62/201; 62/228.5; 62/434

(58) Field of Classification Search ..... None
See application file for complete search history.

(56) References Cited

U.S. PATENT DOCUMENTS 4,402,190 A 8/1983 Reid

FOREIGN PATENT DOCUMENTS

| | | |
|---|---|---|
| FR | 2 258 596 | 8/1975 |
| GB | 699782 | 11/1953 |

*Primary Examiner*—Joseph A. Kaufman

(57) ABSTRACT

A refrigeration system comprises a plurality of assembled modular units each having a refrigeration circuit separate from the circuit of the other units. Each unit includes a housing which defines at least one compartment containing the evaporator of the refrigeration circuit. The condenser is either located in a second compartment in the housing or in a separate chamber associated therewith. A first heat exchange fluid is conveyed to and from the compartment by header pipes, the header pipes of adjacent units being interconnected to form common manifolds for the system. A second heat exchange fluid is circulated passed the condensers of each unit. Electrical controls are provided on each unit control and monitor operation of the respective refrigeration circuit the controls being interconnected to enable overall control of each unit of the system in accordance with load demand.

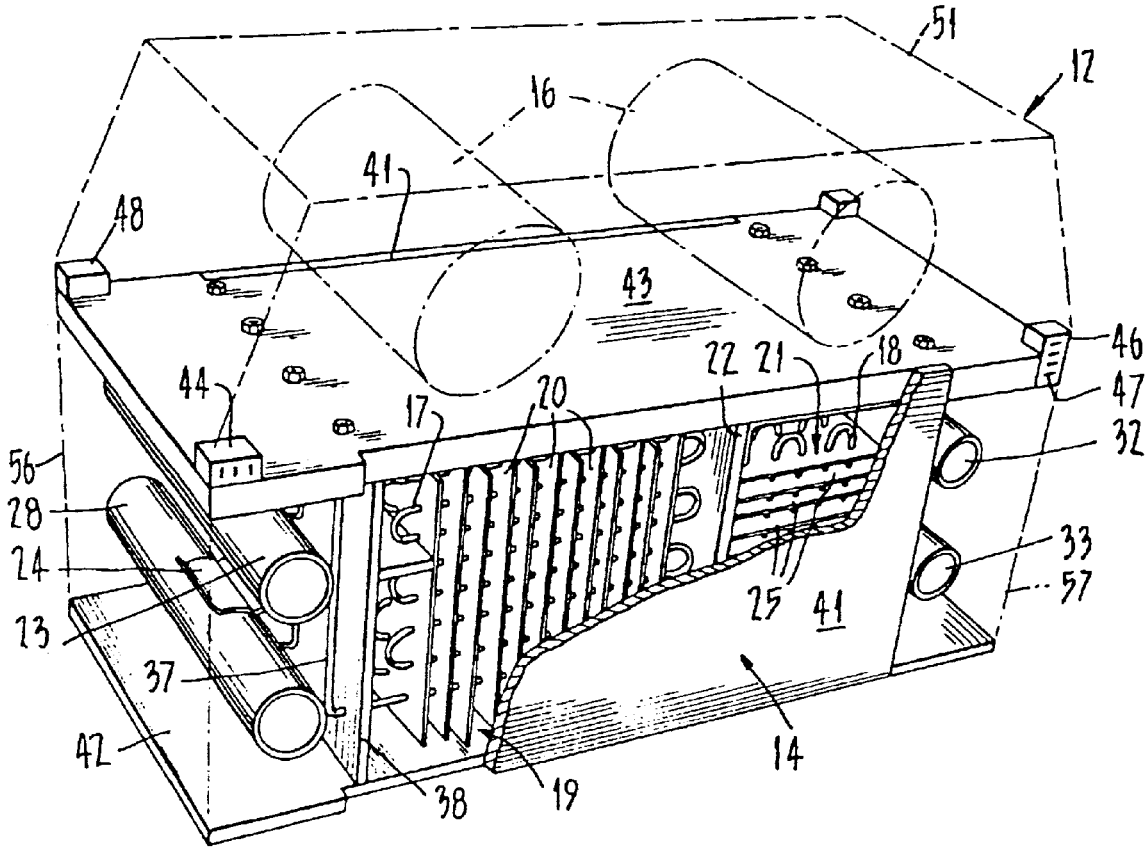

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *